US005644111A

United States Patent [19]

Cerny et al.

[11] Patent Number: 5,644,111

[45] Date of Patent: Jul. 1, 1997

[54] ELEVATOR HATCH DOOR MONITORING SYSTEM

[75] Inventors: Bohuslav Cerny; Anthony Geniale; John Ashton; Domenico Vitulli, all of New York, N.Y.

[73] Assignee: New York City Housing Authority, New York, N.Y.

[21] Appl. No.: 436,933

[22] Filed: May 8, 1995

[51] Int. Cl.[6] ..... B66B 1/28; B66B 1/34

[52] U.S. Cl. ..... 187/393; 187/391; 187/390; 187/280

[58] Field of Search ..... 187/279, 280, 187/316, 317, 391, 393, 390

[56] References Cited

U.S. PATENT DOCUMENTS

| | | | |
|---|---|---|---|
| Re. 33,668 | 8/1991 | Gray | 250/221 |
| 1,887,209 | 11/1932 | Lucas . | |
| 1,947,079 | 2/1934 | Ellis, Jr. | 187/52 |
| 2,109,361 | 2/1938 | Spiegel | 95/11 |
| 2,193,609 | 3/1940 | Williams et al. | 177/336 |
| 2,227,147 | 12/1940 | Lindsay | 250/41.5 |
| 2,417,092 | 3/1947 | Smith | 273/50 |
| 2,631,273 | 3/1953 | Bagno | 340/228 |
| 2,806,555 | 9/1957 | Suozzo | 187/29 |
| 2,900,521 | 8/1959 | Eames | 250/208 |
| 2,909,767 | 10/1959 | Zaltman | 340/276 |
| 3,091,760 | 5/1963 | Spenard et al. | 340/378 |
| 3,168,164 | 2/1965 | Kiely | 187/29 |
| 3,176,797 | 4/1965 | Dinning | 187/29 |
| 3,207,266 | 9/1965 | Hornung | 187/29 |
| 3,370,285 | 2/1968 | Cruse et al. | 340/258 |
| 3,461,422 | 8/1969 | Hansen | 340/21 |
| 3,545,572 | 12/1970 | Hallene et al. | 187/52 |
| 3,605,082 | 9/1971 | Matthews | 340/258 |
| 3,609,730 | 9/1971 | Hornung | 340/214 |
| 3,641,549 | 2/1972 | Misek et al. | 340/258 B |
| 3,644,917 | 2/1972 | Perlman | 340/258 B |
| 3,742,222 | 6/1973 | Endl | 250/209 |
| 3,745,550 | 7/1973 | Anthony et al. | 340/258 B |
| 3,746,863 | 7/1973 | Pronovost | 250/208 |
| 3,760,397 | 9/1973 | Taggart | 340/258 B |
| 3,773,145 | 11/1973 | Drexler | 187/29 R |
| 3,816,745 | 6/1974 | Primm et al. | 250/221 |
| 3,825,745 | 7/1974 | Thomson | 250/208 |
| 3,857,466 | 12/1974 | Berkovitz et al. | 187/52 |
| 3,903,996 | 9/1975 | Berkovitz et al. | 187/52 |
| 3,914,753 | 10/1975 | Cho | 340/258 B |
| 4,009,389 | 2/1977 | Lindholm | 250/221 |
| 4,052,716 | 10/1977 | Mortensen | 340/233 |

(List continued on next page.)

FOREIGN PATENT DOCUMENTS

| | | | |
|---|---|---|---|
| 1-299174 | 12/1989 | Japan | 187/280 |
| 2169482 | 6/1990 | Japan | B66B 5/00 |
| 3-158370 | 7/1991 | Japan | 187/279 |
| 876371 | 8/1961 | United Kingdom | 187/280 |

OTHER PUBLICATIONS

Bulletin PA–1803 "Photoswitch" Allen–Bradley Co., Nov. 1988.

Heimplaetzer et al. "Alternative Safety Equipment for Elevators" Jun. 1990 (regulation in Sweden and the Netherlands).

*Primary Examiner*—Robert Nappi

*Attorney, Agent, or Firm*—Darby & Darby

[57] ABSTRACT

An elevator door monitoring system determines if any hatch door at any floor along an elevator shaft or any other door leading to the shaft is opened while an elevator cab is away from the door. The system includes a plurality of non-contact hatch door monitors, such as infrared proximity detectors. At least one monitor is positioned on the elevator shaft at a respective location generally opposite each hatch door along the shaft. Each monitor detects the opening of the respective hatch door without direct contact therewith, e.g., by directing radiation toward the door and measuring the distance to the door. If the distance is too great, indicating that the door is open and no elevator is present, the monitor produces an alarm signal. The alarm signal is sent to a control circuit which takes the elevator out of service and operates audible and visual alarms in response thereto.

27 Claims, 11 Drawing Sheets

U.S. PATENT DOCUMENTS

| | | | |
|---|---|---|---|
| 4,067,416 | 1/1978 | Lowry | 187/29 R |
| 4,092,636 | 5/1978 | Shepherd, Jr. | 340/274 R |
| 4,108,281 | 8/1978 | Glaser | 187/29 R |
| 4,207,466 | 6/1980 | Drage et al. | 250/338 |
| 4,266,124 | 5/1981 | Weber et al. | 250/221 |
| 4,326,197 | 4/1982 | Evin | 340/561 |
| 4,384,280 | 5/1983 | Haag | 340/556 |
| 4,399,430 | 8/1983 | Kitchen | 340/550 |
| 4,460,066 | 7/1984 | Ohta | 187/29 R |
| 4,479,053 | 10/1984 | Johnston | 250/221 |
| 4,507,654 | 3/1985 | Stolarczyk et al. | 340/545 |
| 4,520,343 | 5/1985 | Koh et al. | 340/19 R |
| 4,581,526 | 4/1986 | Brattgard | 250/221 |
| 4,590,410 | 5/1986 | Jönsson | 318/480 |
| 4,644,329 | 2/1987 | Brueske | 340/556 |
| 4,716,992 | 1/1988 | Kunii | 187/121 |
| 4,733,081 | 3/1988 | Mizukami | 250/341 |
| 4,742,337 | 5/1988 | Haag | 340/556 |
| 4,839,631 | 6/1989 | Tsuji | 340/541 |
| 4,879,461 | 11/1989 | Philipp | 250/221 |
| 4,893,005 | 1/1990 | Stiebel | 250/221 |
| 4,897,630 | 1/1990 | Nykerk | 340/426 |
| 4,910,464 | 3/1990 | Trett et al. | 328/5 |
| 4,942,385 | 7/1990 | Kobayashi et al. | 340/556 |
| 4,973,837 | 11/1990 | Bradbeer | 250/221 |
| 4,976,337 | 12/1990 | Trett | 187/51 |
| 4,987,402 | 1/1991 | Nykerk | 340/426 |
| 5,015,840 | 5/1991 | Blau | 250/221 |
| 5,025,895 | 6/1991 | Leone et al. | 187/105 |
| 5,053,616 | 10/1991 | Trett | 250/221 |
| 5,138,150 | 8/1992 | Duncan | 250/221 |
| 5,149,921 | 9/1992 | Picado | 187/130 |
| 5,202,540 | 4/1993 | Auer et al. | 187/101 |
| 5,283,400 | 2/1994 | Leone et al. | 187/140 |
| 5,347,094 | 9/1994 | Leone et al. | 187/140 |
| 5,443,142 | 8/1995 | Glaser et al. | 187/316 |
| 5,476,157 | 12/1995 | Todaro | 187/320 |
| 5,487,448 | 1/1996 | Schollkopf et al. | 187/247 |

ELEVATOR HATCH DOOR MONITORING SYSTEM

BACKGROUND OF THE INVENTION

This invention relates to elevator safety systems and, more particularly, to systems for monitoring the inappropriate opening of an elevator hatch door.

The typical elevator system includes a vertical shaftway or hoistway that extends between several floors of a building, and a cab suspended from cables that cause the cab to travel up and down the shaftway on command. There are two types of elevator doors in any modern elevator system. A first door, called a hatch or shaftway door, is located at every floor and under normal operation it is opened only when an elevator is aligned with the particular floor and has completely stopped. The main purpose of the hatch door is to prevent people from falling down the shaft when the elevator is elsewhere within the shaftway. If, for example, the cab is on the first floor and the hatch door on the fifth floor is open or is at least unlocked, someone could walk into the shaftway and fall four floors onto the top of the cab, causing injury and even death. The hatch door also prevents injury to people on a floor who might be struck by the elevator as it passes the shaftway entrance on that floor. A closed shaftway door is a reminder to those people on a particular floor that the elevator cab is not ready to pick them up.

The second type of elevator door, a cab door, is similar to the shaftway door, but is located on the elevator cab itself. Under normal conditions, it is opened only when the cab is aligned with a floor. The purpose of the cab door is to protect the passengers on the moving elevator cab from injury due to contact with the parts of the shaftway which are otherwise exposed and accessible as the elevator cab ascends and descends within the shaftway.

Elevator systems are arranged so that all of the hatch doors are kept closed, except for the hatch door on the floor where the cab has stopped and is aligned with the hatch door. This is accomplished with electromechanical interlocks that prevent the shaft or hatch doors from being opened when no elevator is present. In fact, these interlocks are typically required by local law or ordinance.

The interlock may be in the form of a mechanical lever mounted in the shaft adjacent each hatch door. This lever is biased so that one end rotates into locking connection with the hatch door. The other end of the lever has a roller on it which engages a cam on the cab. As the cab approaches a floor, the cam causes the lever to rotate out of its locking position, permitting the hatch door on that floor to be opened. In addition to the mechanical interlock, the lever operates an electrical switch at each hatch door. The switches on each floor are connected in series and are part of the elevator control circuit in the machine or motor room on the roof. If a hatch door is opened by any means other than the cab, the electrical switch will open, which will cause the control circuit to stop the elevator and/or take it out of service. However, if the lever is in the door open position because the cab is at that floor, the switch at that floor is open, so there will be no signal taking the elevator out of service.

Some systems use the switch on the shaftway or hatch door to sound an alarm if the elevator moves away from a floor prior to the hatch door on that floor being fully closed (see U.S. Pat. No. 355,384 of Chinnock; U.S. Pat. No. 642,332 of Hunter and U.S. Pat. No. 777,612 of Eaton). Similarly, U.S. Pat. No. 3,091,760 of Spenard et al. discloses a burglar alarm switch assembly which is mounted along the inside surface of each sliding shaftway door to provide a signal when it is improperly opened.

Even though the interlocks are designed to provide some protection against accidental entry into an elevator shaft when the cab is not present, accidents still happen. The electromechanical interlocks are subject to repeated operation over years of operation. Also, an elevator shaft is a harsh environment, with water and debris falling down the shaft from time to time, and significate temperature conditions. As a result, the interlocks fail in ways that may be undetected by normal inspections and people continue to be injured.

The electromechanical hatch door interlocks help to prevent injury to building occupants engaged in normal use of elevators. However, in recent years injuries and death have resulted from the unauthorized use of elevators, particularly were individuals gain access to the top of the elevator cab and ride there for purposes of enjoyment or for purposes of extorting money from or robbing legitimate passengers. In particular, young children have been known to work together to gain access to the top of the elevator in order to ride there as a dangerous form of entertainment. Also, older individuals have gained access to the top of the elevator cab in order to extort money from passengers in the cab by disabling the elevator and refusing to restore service until they are paid. Further, some even employ weapons to rob the passengers. This situation has led to the injury and death of the people who ride on top of the elevator for enjoyment as well as to the victims of the people who gain access to the top of the elevator for purposes of robbery and extortion.

Unauthorized access to the top to the elevator or the shaft can be gained by stopping the elevator at one floor and attaching a rope of flexible metal wire to the interlock lever. Then an accomplice takes the elevator down one floor. The rope or wire is pulled, causing the lever to rotate as if the cab were at that floor. This opens the switch at that floor and releases the mechanical interlock for the hatch door on that floor. As a result, the hatch door on the floor above the cab can be open, thus allowing the individual to gain access to the elevator shaft or the top of the cab. The elevator control circuits are wired so that the elevator is returned to service as soon as the switch has been restored to it proper position, e.g., by closing the hatch door once the individual has gained access to the elevator shaft and to the top of the cab.

U.S. Pat. No. 3,677,370 of Devine discloses an elevator alarm system which sounds after the cab doors have been forced open between floors for a predetermined period of time. This patent describes the problem of people gaining access to the top of the elevator for purposes of robbery and extortion. The theory of this patent is that a robbery will require that the doors be open for some period of time, while a child opening the doors as a form of play will hold them open only for a few seconds. Therefore, a timed activation of the alarm can be used to distinguish a serious problem from less serious play. Thus, while recognizing the problem of unauthorized travel on an elevator, it does not prevent the problem.

A series of patents to Leone (i.e., U.S. Pat. Nos. 5,025,895; 5,283,400 and 5,347,094) describe the use of proximity detectors mounted on the top and bottom of elevator cabs to detect the presence of an intruder on those areas of the cab. Basically, the proximity detectors are aimed at the hatch doors on the floors above and/or below the cab. These detectors send out periodic pulses of light which are a few inches wide. These pulses are diffused off the hatch doors, typically the edge which first opens. The detector picks up the diffused light and measures the time it took for the light beam to travel to the door and return. Unless this is equal to or less than a prescribed period of time, an alarm condition is indicated. For example, if the door is opened, the beam either does not return or it takes longer to return because it must travel into the hallway adjacent the hatch door and strike a wall or some other object before returning to the detector. When an alarm condition is detected, an alarm siren is sounded, a warning strobe light is lit and the elevator is taken out of service. In this system the elevator remains out of service until restored by elevator personnel.

With the Leone system where only the door above or below the cab is monitored, individuals can go to the second floor above the cab, open that door and slide down the elevator cable to the top of the cab. To prevent this, additional monitors are used which sound an alarm only when the person is in the dangerous position of sliding down the cables. Triggering an alarm at that point might frighten them, causing them to fall.

It would be advantageous if a system were designed to provide improved protection to (i) building occupants from defective hatch door interlocks, which may allow them to fall into elevator shaftways, and from individuals bent on robbery or extortion; (ii) young children seeking thrills from riding on top of elevators; and (iii) building owners who are liable for the injuries to legitimate users of the elevators and perhaps even to those bent on larceny.

SUMMARY OF THE INVENTION

The present invention is directed to a system for substantially eliminating unintended and unauthorized access to an elevator shaft by monitoring all entrances to the shaft. In this way a backup is provided for the electromechanical interlocks and an indication is provided as to which floor has its hatch door open, whether correctly or not.

In an illustrative embodiment of the invention the system includes a plurality of monitoring or detector devices, with one such device located within the shaftway opposite to each hatch door. Each monitoring device is in the form of an infrared photoelectric detector device with a generator that creates a pulsed beam of light directed toward the hatch door. This pulse of light is reflected or diffused from an interior surface portion of each respective hatch door to a receiver. The amplitude of the received pulse is measured. If the amplitude of the light beam received by the receiver if above a predetermined value, it is taken as an indication that the hatch door is closed or the elevator is in front of the hatch door. However, if the pulse of light is not returned to the detector, or it travels too far before returning, it amplitude is below the predetermined value, which is taken as an indication that the elevator is not at the hatch door and the door is open, i.e., the beam has traveled beyond the hatch door into the hallway on that floor. When this occurs, the circuit trips an alarm, activates a flashing light (e.g., a strobe) and takes the elevator out of service so it will not move.

The alarm and light can be located at the top and bottom of the shaftway or next to each shaftway door in order to indicate to people on that floor that something is wrong.

Additional detectors can be located to monitor other doors to the shaft, e.g., the emergency door on the top or side of an elevator, the door to the elevator pit or the door or hatch to the motor or machine room, which is usually located on the roof of the building. In this way, unlike the Leone patents in which only the doors on the floors above or below the cab are monitored, every entrance to the shaftway is monitored.

The output signals from each monitoring device are directed to a control circuit which analyzes them, perhaps in combination with signals from other detection devices such as the interlocks, and determines if someone has accidently or illegally opened an access to the shaftway. This system provides a warning as soon as the access has been established and before someone has actually entered the shaftway. Thus, if the door interlock on a floor has failed, the alarm will still operate as soon as the hatch door on that floor is opened and before someone steps into the shaft. Also, opening the hatch door a floor or two above the cab will trigger an alarm before someone forces the door open and starts to slide down the cables.

BRIEF DESCRIPTION OF THE DRAWINGS

The foregoing and other features of the present invention will be more readily apparent from the following detailed description and drawings of illustrative embodiments of the invention in which.

DESCRIPTION OF ILLUSTRATIVE EXEMPLARY EMBODIMENTS

Figure 1A:
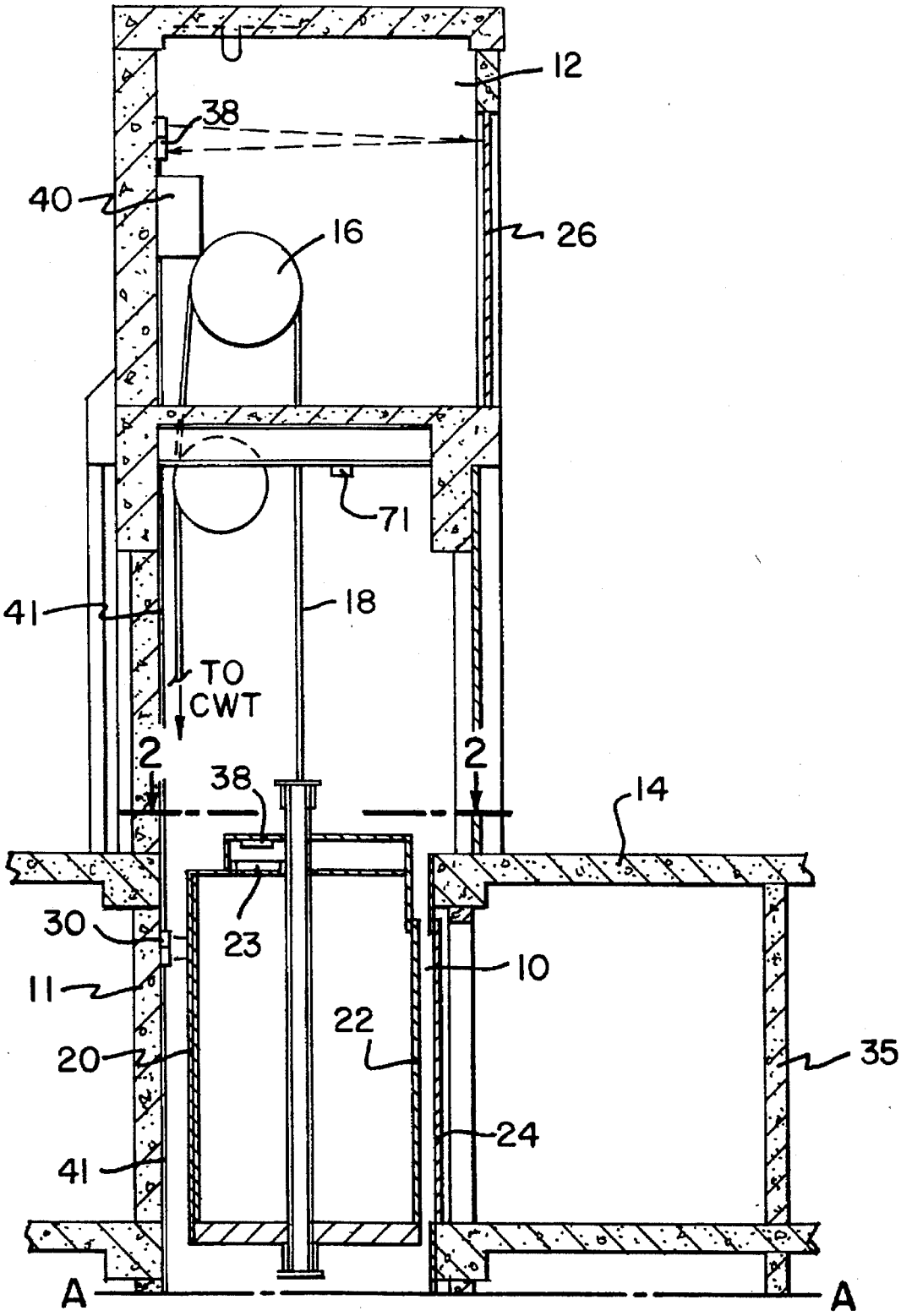
FIG. 1 is a schematic cross-sectional elevation view of an elevator shaft in a building incorporating the present invention.
Figure 1B:
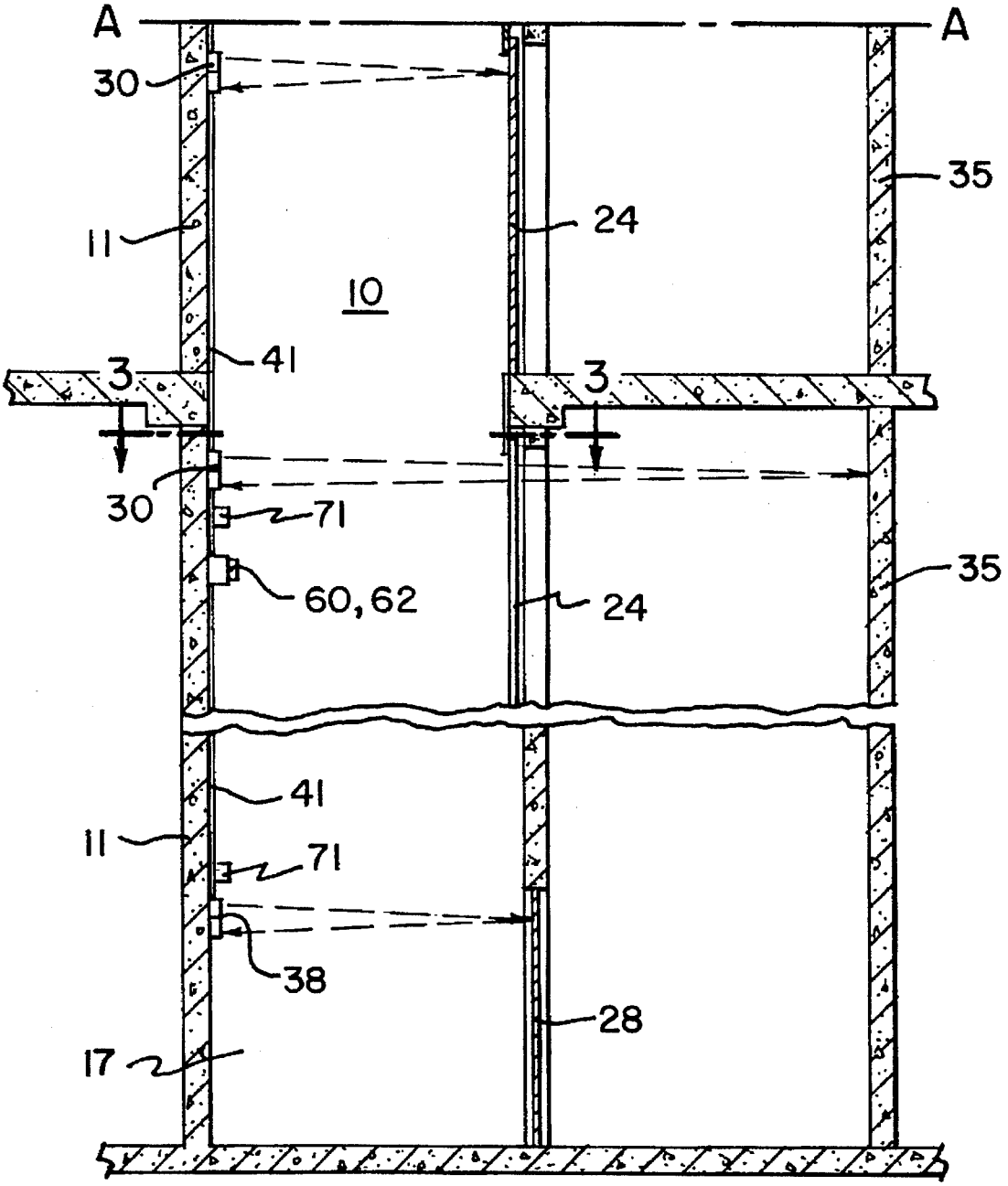

FIG. 1 illustrates an elevator shaft or shaftway 10 of a building which extends from a machine room 12 on the roof 14 of the building to an elevator pit 14 in the basement. In the machine room there are hoist motors 16 that control the movement of elevator cables 18 and motor control circuits 40. One end of the cables is attached to a counter weight 15 (shown in FIGS. 2 and 3) while the other end is attached to an elevator cab 20 which is mounted for vertical movement in the shaft 10. The cab has a door 22 which keeps passengers riding in the cab from coming into contact with the walls of the shaft as the cab moves. In addition, there are shaftway or hatch doors 24 at each floor, a door 26 to the machine room on the roof, a door 28 to the elevator pit in the basement, and a door 23 on the roof of the cab.

These doors allow access to the elevator shaft in one way or another, and a feature of the present invention is to monitor most or all of these doors to prevent unauthorized or accidental access to the shaft. As is known in the art, at least the hatch doors 24 can be monitored by electrical switches which are part of the hatch door interlock.

However, as explained above, this switch monitor can be defeated by a length of wire that is connected to the interlock lever so as to open the hatch door when the elevator is not at that floor and open the switch.

According to the present invention an additional non-contact monitor is provided, for example, an infrared diffuse photoelectric detector 30 (FIG. 2) such as that made by MICRO SWITCH, a division of Honeywell Corporation, as models MPD1 or MPD2. As shown in FIG. 1, these photoelectric detectors are attached to the rear wall 11 of the shaft opposite each of the hatch doors 24 and are used to monitor the condition of the hatch doors in addition to the interlock switches. The selected detectors have a range of up to 10 feet which is ideal for most elevator shafts.

Figure 2:
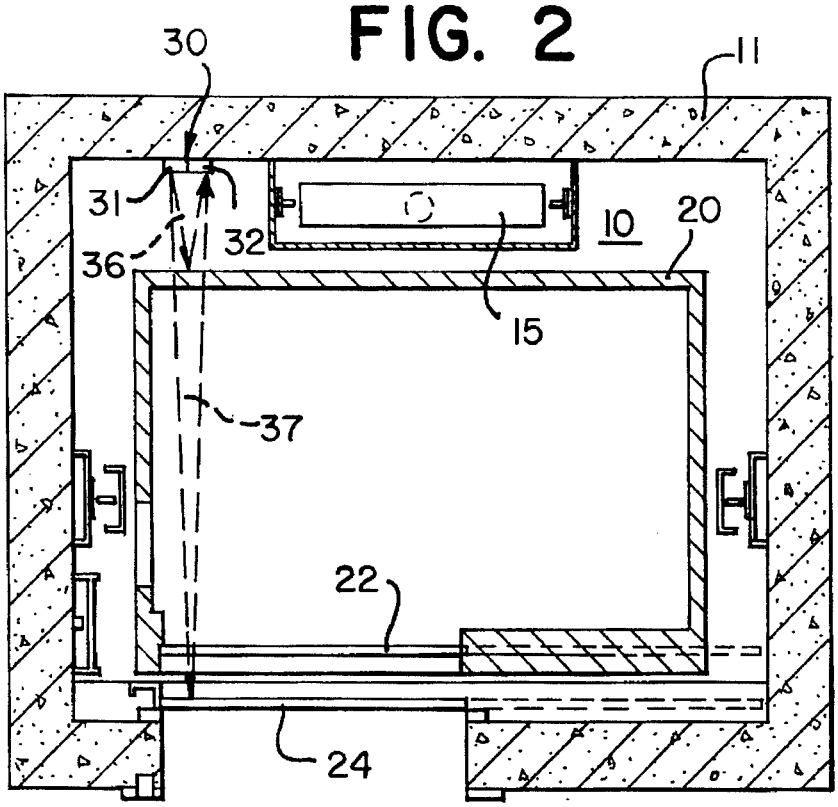
FIG. 2 is a schematic cross-sectional plan view of the shaft of FIG. 1 along line 11—11 showing a monitor beam in relation to a closed hatch door.

As best seen in FIG. 2, which is a cross section of the shaft along the line II—II in FIG. 1 just above the elevator cab 20, each detector 30 includes a source or generator portion 31 that periodically produces an infrared light pulse of a particular frequency. This pulse is directed across the shaft 10 to the edge of the hatch door that first opens. When the light pulse strikes the hatch door 24 it is diffused or reflected back to a receiver portion 32 of the detector 30. The amplitude of the light pulse diffused back to the receiver 32, i.e. a light pulse of the same frequency, is measured by the detector. The voltage amplitude is a measure of the distance, i.e., its proximity to the detector. By synchronously sending and receiving light pulses of the same frequency, ambient light and other noise can be eliminated from the determination. The amplitude is compared in a comparator to a standard value that can be set in the detector, usually by adjusting a variable resistor to set a voltage to be compared to the detected voltage. If the distance is less than the standard value which is set, nothing happens. However, if the distance is greater than the standard or reference, than an alarm signal is generated, which may be used to close or open a relay contact in the detector.

Figure 3:
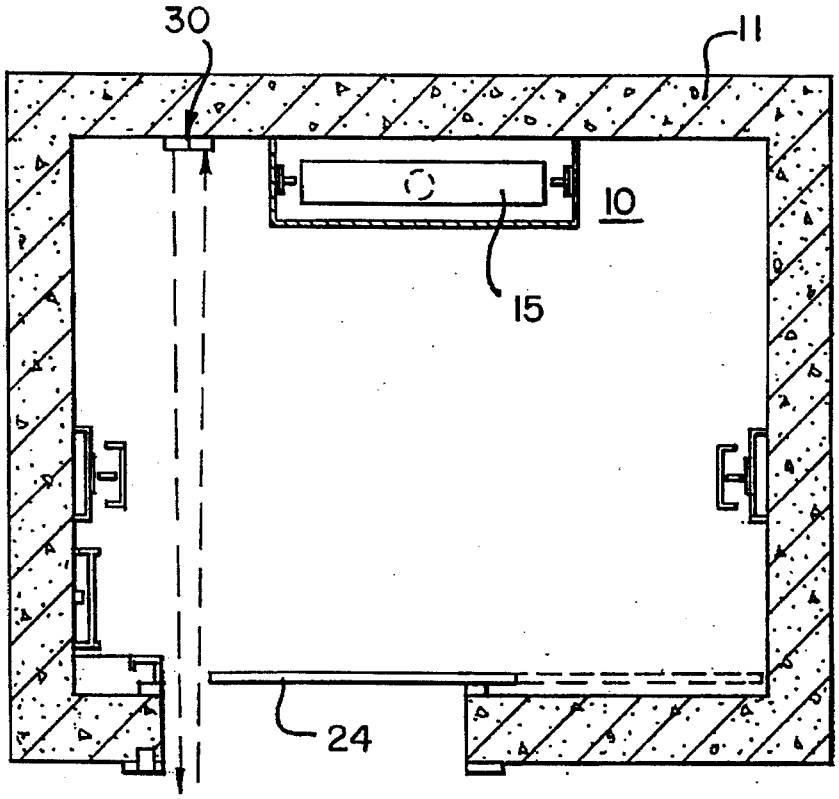
FIG. 3 is a schematic cross-sectional plan view of the shaft along line III—III in FIG. 1 showing a monitor beam in relation to a slightly opened hatch door.

Referring to FIG. 3, which is a cross section of the shaft 10 in the direction of line 111—111 at a floor where the hatch door is open, when the hatch door 24 just beings to open, the light pulse extends beyond the hatch door, so either it is returned to the receiver with reduced amplitude after being diffused off the corridor wall 35 (FIG. 1 ), or it does not return at all. In either case, the detector generates an alarm signal, which may be the closing or opening of a relay contact. It should be noted that the pulse is aimed at the portion of the hatch door which first opens, i.e., the left side of the sliding hatch door shown in FIG. 3. Thus an alarm is indicated before the door is open enough for anyone to gain access to the shaft.

In FIG. 2 the light pulse beam 37 is shown normally extending over the top of the elevator cab 20 to reach the hatch door 24. However, it may be the case that the elevator cab blocks the light pulse from reaching the hatch door. In effect, the pulse beam 36 diffuses off the cab as shown in FIG. 2. In such a case, there is no problem because the beam will return to the receiver with a greater amplitude than if it had traveled to the hatch door. The alarm condition is established in this particular device only when the distance is longer than the standard, so no alarm condition exists when the cab blocks the light beam.

As illustrated in FIG. 1, additional monitors 38 may be located in the machine room 26 and the pit 14 to monitor the doors 26 and 28 that provide access to those areas. In this way, all access to the shaft 10 is monitored, except for access from the cab through a hatch 23 in its roof. This may also be monitored by a detector 38 mounted on the roof of the cab and directed at the cab escape hatch. If the cab has a side escape hatch (e.g., where there are two shafts side-by-side) which allows passengers to escape from one cab to an adjacent one, this side hatch can also be monitored by a detector 38.

The monitors 38 may be photoelectric detectors, as are the detectors 30. However, they may be simple microswitches or magnetic switches, since they can not be operated by a wire wrapped about a door interlock, as can the switches for the hatch doors.

While, the detectors 30 are described as infrared photoelectric detectors, they could also be other types of non contact switches, e.g., switches that work on other types of electromagnetic energy, such as microwave and sonic pulsed proximity detectors; continuous beam proximity detectors; infrared and visible light retroreflective detectors; thru-beams; or infrared intrusion detectors. With continuous beam proximity detectors, a continuous beam of light is generated and is diffused from a surface of the hatch door. The proximity of the door to the detector is measured by the amplitude of the return beam. The stronger it is, the closer the door. When the door is moved the strength of the diffused beam decreases, thus generating an alarm condition. With retroreflective detectors, a continuous beam of light is also generated and is reflected from a reflective surface mounted on the hatch door. When the door is moved the reflective material moves out of the beam so it no longer reflects light back to a receiver, thus generating an alarm condition. With the infrared intrusion detectors, a heat source is located on the door and monitored by an infrared detector. When the door is moved, the heat source moves out of the detection zone of the detector, thereby generating an alarm condition.

Various other detector systems may be used, but preferably they are, at least in part, mounted against the back wall 11 of the shaft where they are difficult to reach and disable. Also, the back wall is a much safer location than the front wall where the interlock switches are located. For example, when the floors of a building are mopped, the excess water tends to enter the shaft and run down the front wall. Also, it has been found that debris is more likely to strike the front wall.

Figure 4A:
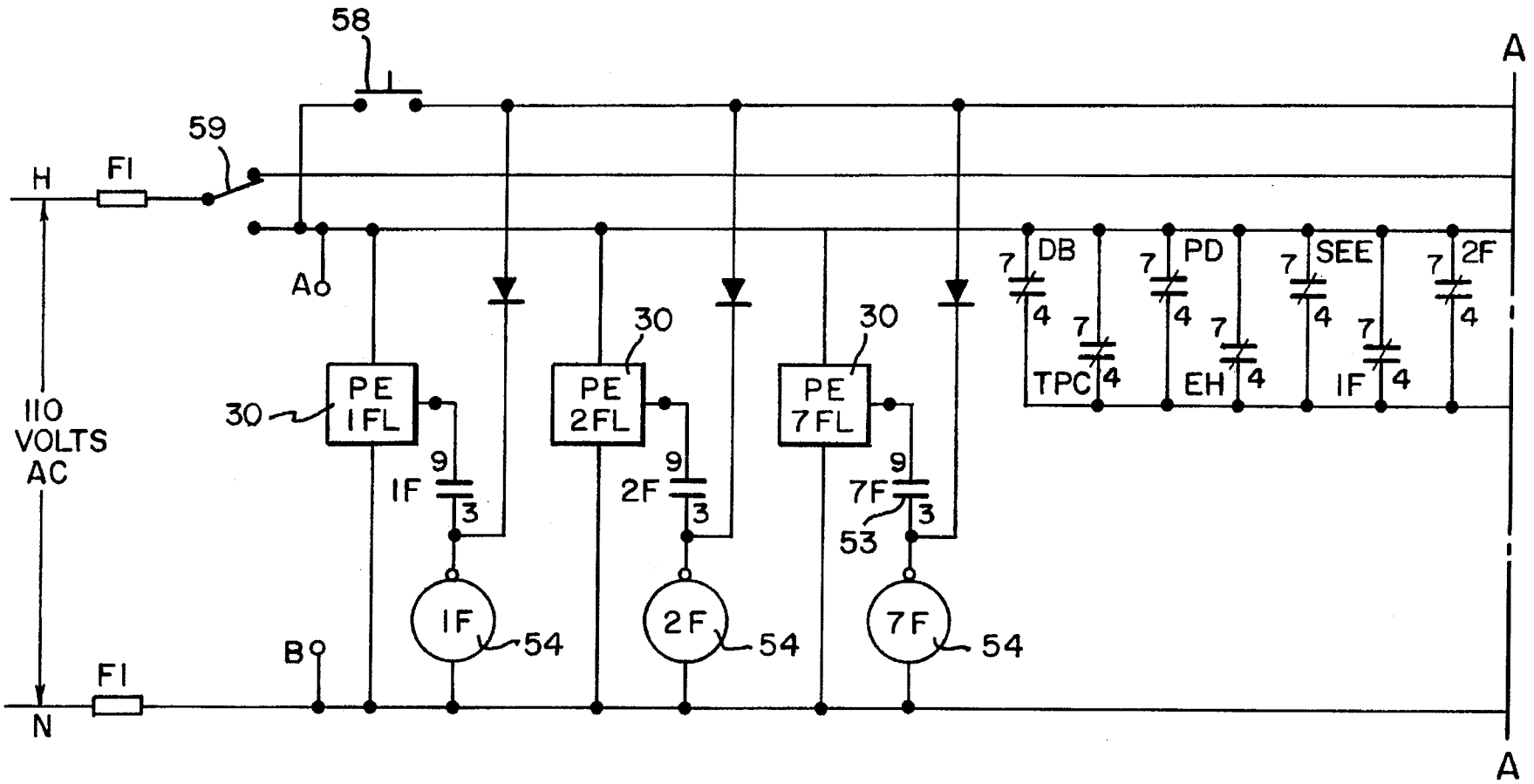
FIG. 4 is an electrical schematic of an exemplary control system for the present invention.
Figure 4B:
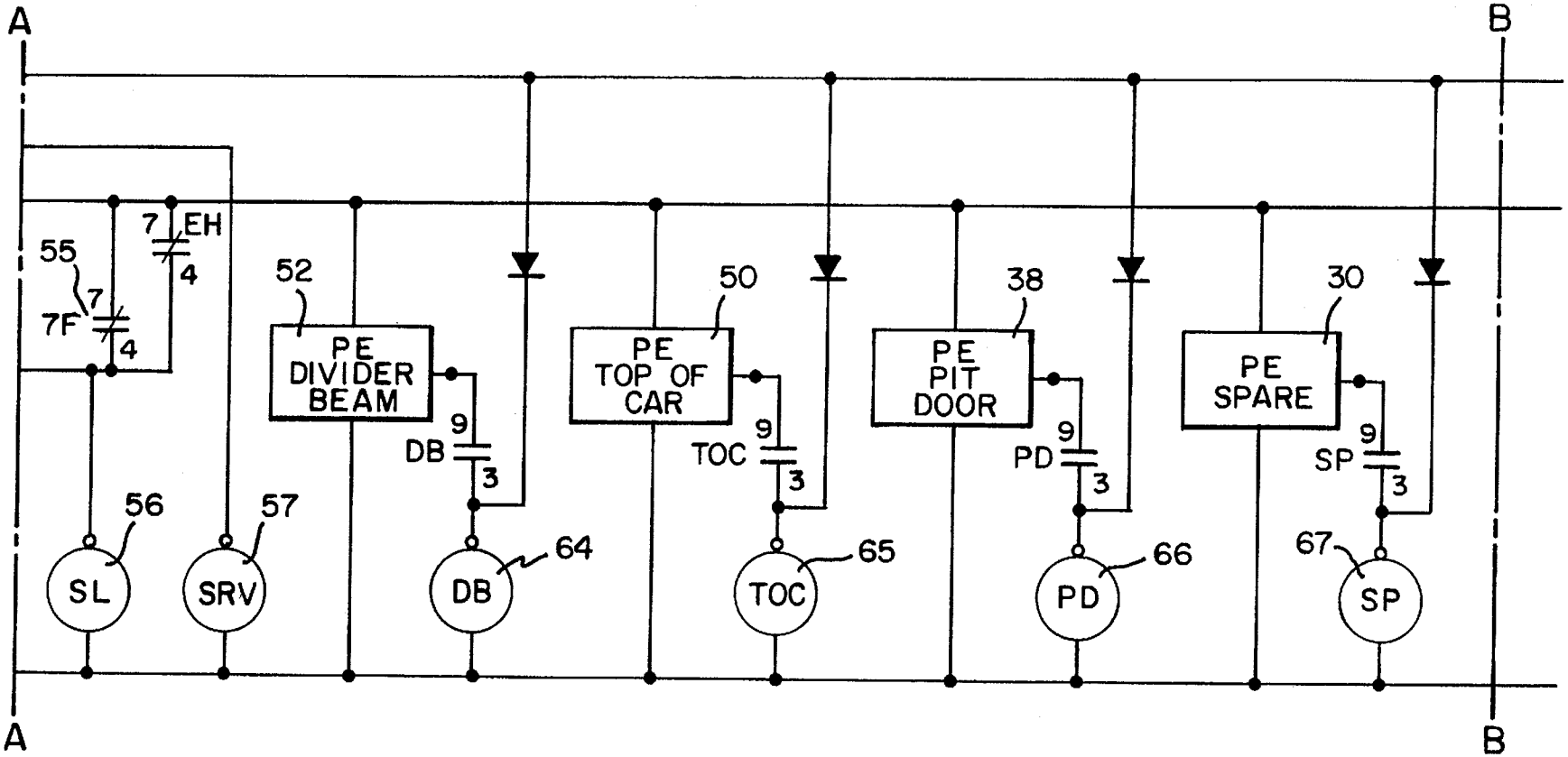
Figure 4C:
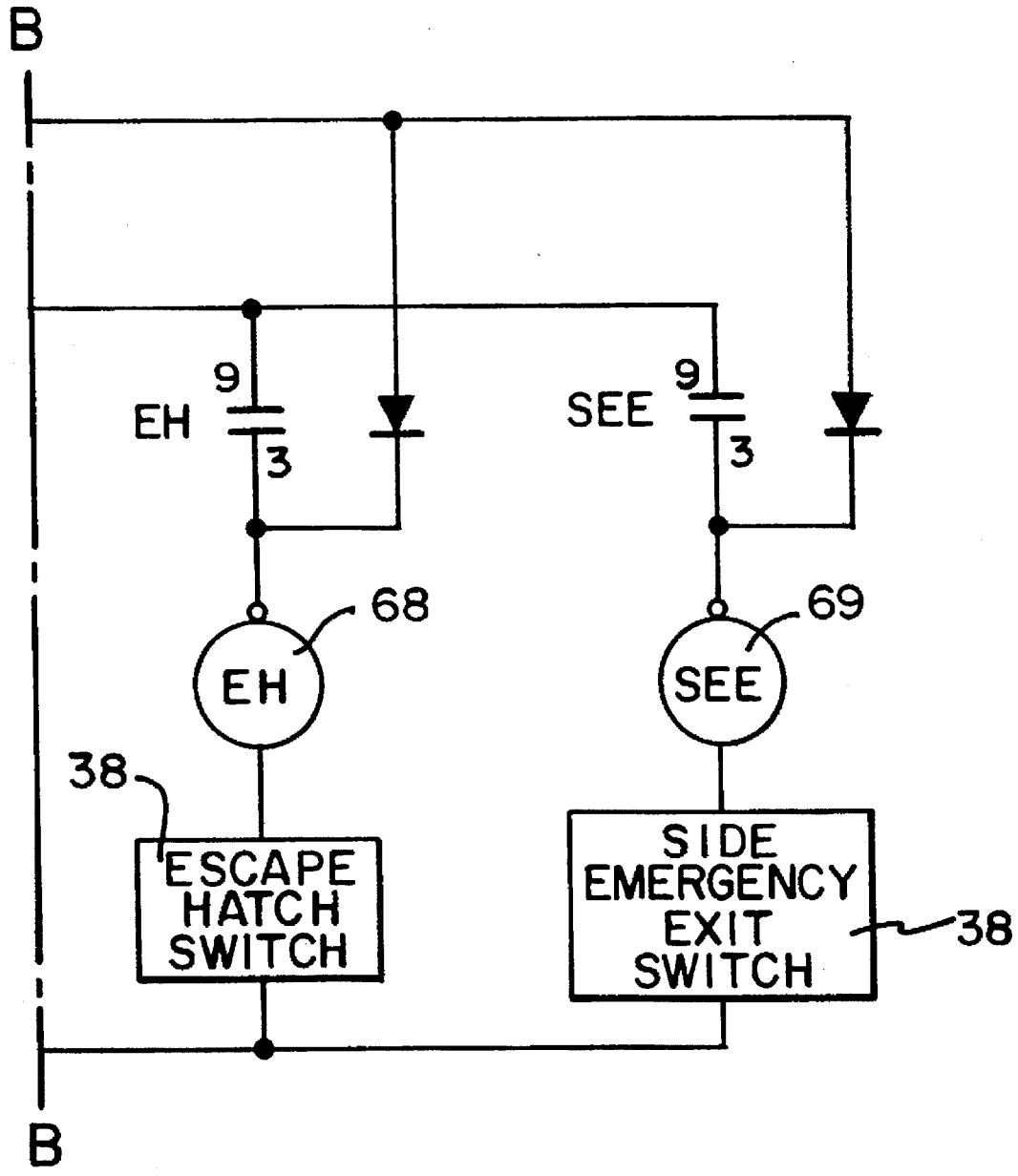

The detectors 30, 38 are connected to a control circuit 40 by wires located in metal conduits 41 (FIG. 1). Wires supplying power to the detectors also extend through the conduits. The power for the detectors is kept separate from the elevator power so power can be cut to the elevator for service, while continuing to have the detectors monitor the doors. The control circuit 40 may be in any location, but is preferably in the machine room 12 where the other elevator controls are located. An exemplary embodiment of a control circuit is shown in FIG. 4.

The photoelectric detectors 30 are shown connected across an ac power supply line. These are illustrated for the 1st, 2nd and 7th floor hatch doors, as well as a spare. In addition, detectors 38 for the pit door, cab roof escape hatch and a side escape hatch are shown connected across the same power line. If the present invention is used in connection with intruder detection devices such as that described in the Leone patents mentioned above, the control will also include a top-of-car detection device 50. It may also include, e.g., thru-beam detector 52 mounted on the divider beam between elevators in a duplex system to detect an intruder standing on the divider beam to get access to one of the elevators. Thru-beams may also be mounted on top of elevators in a duplex system to detect an intruder moving from the top of one car to an adjacent one.

If a detector 30, e.g., the one for the 7th floor, indicates that the hatch door is open on the 7th floor and the elevator is not there, e.g., because the cab is not blocking the beam, a dangerous condition exists. For example, the door interlock may have been disabled by a length of wire, so its switch is not activated. An occupant of the building, particularly a blind person or someone otherwise preoccupied, could then walk into the open shaft and fall. However, due to the present invention, the detector for the 7th floor will signal an alarm condition, such as by closing relay contacts associated with it. In this case one set of contacts 53 will de-energize the 7F relay and its lamp 54 which indicates that the hatch door on the 7th floor is open. Another set of contacts 55 will close, which supplies current to SL relay and its lamp 56 which indicates an alarm condition. Contacts in SL relay 56, provide a dc voltage to a strobe 60 and a siren 62 as shown in FIG. 5B. The siren emits a loud piercing sound and the strobe emits periodic bright flashes of light. As shown in the lower part of FIG. 1, the strobe 60 and siren 62 are located in the shaft 10. They may be at each floor or at convenient locations spaced in the shaft, such that they can be heard and seen by someone attempting to enter a hatch door when the elevator is not there. Anyone attempting to enter the hatch door would be alerted when the door is only ajar, this causing then to stop before the possibility of a fall.

If desired, a time circuit 64 could be optionally included in FIG. 5B. This circuit would cut the power to the siren after a period of time, e.g., 20 minutes, so as not to disturb tenants of the building, who would otherwise have to listen to the sound until an elevator mechanic with access to the machine room arrives and resets the circuit with reset switch 58 (FIG. 4). Assuming the alarm condition has been fixed, e.g., the hatch door closed, the reset switch will reset the relays of the control circuit and allow it to operate in its monitor mode.

Figure 5A:
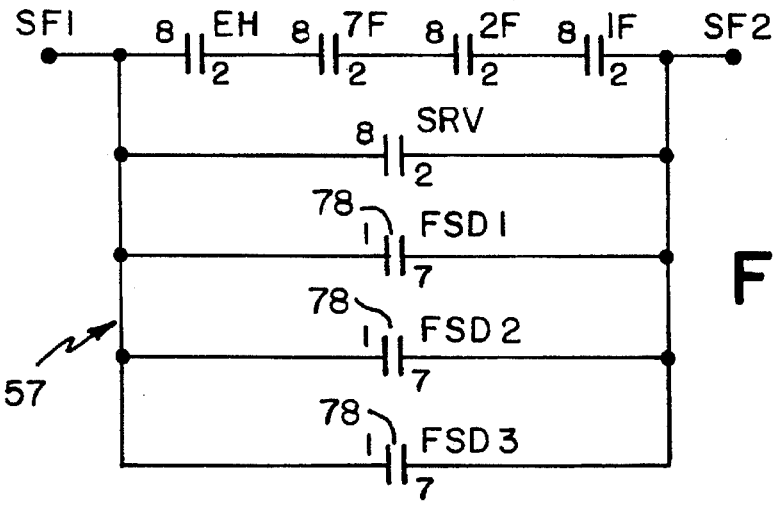
FIG. 5A is an electrical schematic of the elevator shut down control circuit.
Figure 5B:
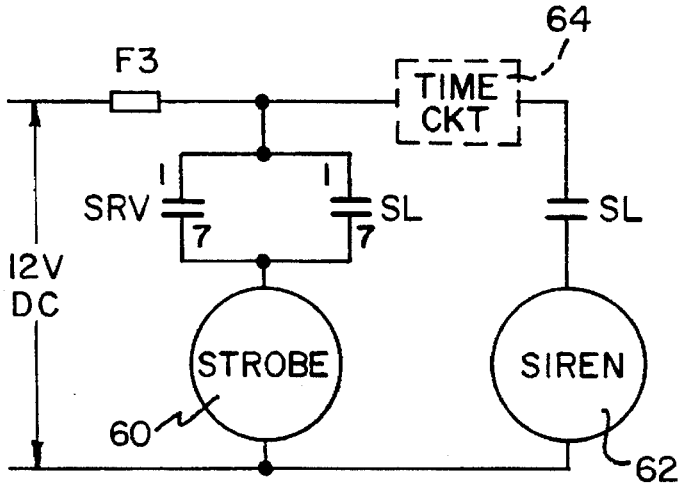
FIG. 5B is a schematic of an alarm circuit including a light strobe and siren and FIG. 5C is a schematic of smoke and fire detection relays.

The operation of the detector 30 for the seventh floor also opens a series of relay contacts shown in FIG. 5A which control the elevator safety circuit. If the contacts for the seventh floor are open, power to the elevator is cut off and the elevator is taken out of service. This service can only be restored by an elevator mechanic with access to the machine room where the control circuit is located. Thus, if children seeking a ride on top of the elevator cab or adults bent on larceny, open any hatch door to gain access to the elevator shaft, the alarm operates and the elevator is taken out of service and can only be returned to service by an elevator mechanic. As a result, there is no opportunity for these dangerous activities.

Each of the devices 30, 38, 50 and 52 cause the control circuit to operate in substantially the same way as the detector 30 for the seventh floor, and need not be discussed in detail, except to state that each has a relay and its lamp 54 associated with it, the diodes in FIG. 4 are provided to isolate the detector circuits from each other, and switches 38 may be contact switches. Relay and lamp 64 are activated by the monitor 52 for the divider beam, relay 65 for the top-of-car monitor, relay 66 for the pit door monitor, relay 67 for the spare monitor, relay EH 68 for the escape hatch and relay SEE 69 for the side emergency switch. The lamps inform service personnel which door is open or was opened to cause the alarm. Thus, the door can be checked and secured before the elevator is returned to service.

If a detector is broken and cannot be replaced immediately, it can be bypassed in the control circuit of FIG. 4 to disable the monitor for that floor or door.

The operation of the system can be halted for maintenance purposes by operation of a service switch 59 (FIG. 4). This switch activates service relay 57. As shown in FIG. 5A, this relay 57 has contacts SRV which short out the alarm contacts so the elevator will be put back in service regardless of the status of the alarm circuit. As shown by the circuit of FIG. 5B, the service switch will also shut off the siren 62 if the system is in an alarm condition, but will allow the strobe to continue to flash.

Figure 5C:
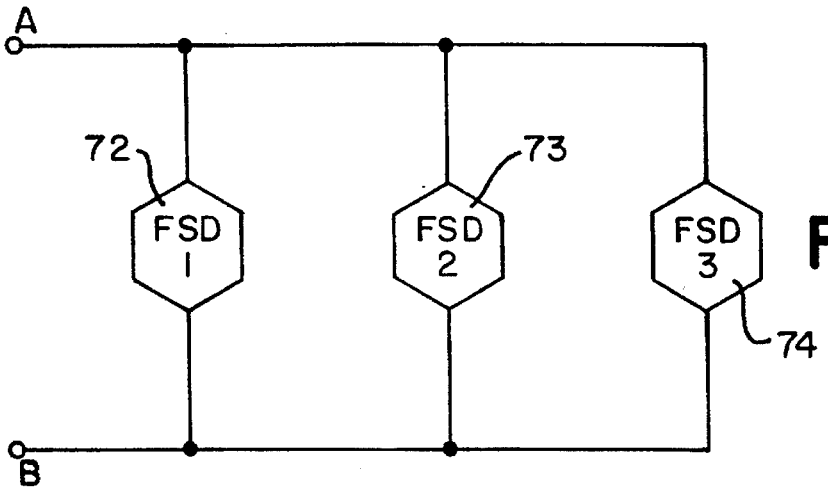

It is desirable to include fire and smoke detectors FSD 71 in the pit, the center of the shaft and the ceiling of the shaft to protect the passengers. If there is an indication of a fire or smoke condition, there should be an override of the alarm system. This is achieved by wiring relays 72, 73 and 74 for the fire and smoke detectors as shown in FIG. 5C. These relays are connected into the control circuit of FIG. 4 at points A and B. When any of these relays operate, they close one of the contacts 78 in FIG. 5A so that the alarm circuit which shuts down the elevator is bypassed and the elevator is kept in service for use by the fire department and passengers under the direction of the fire department.

Figure 6:
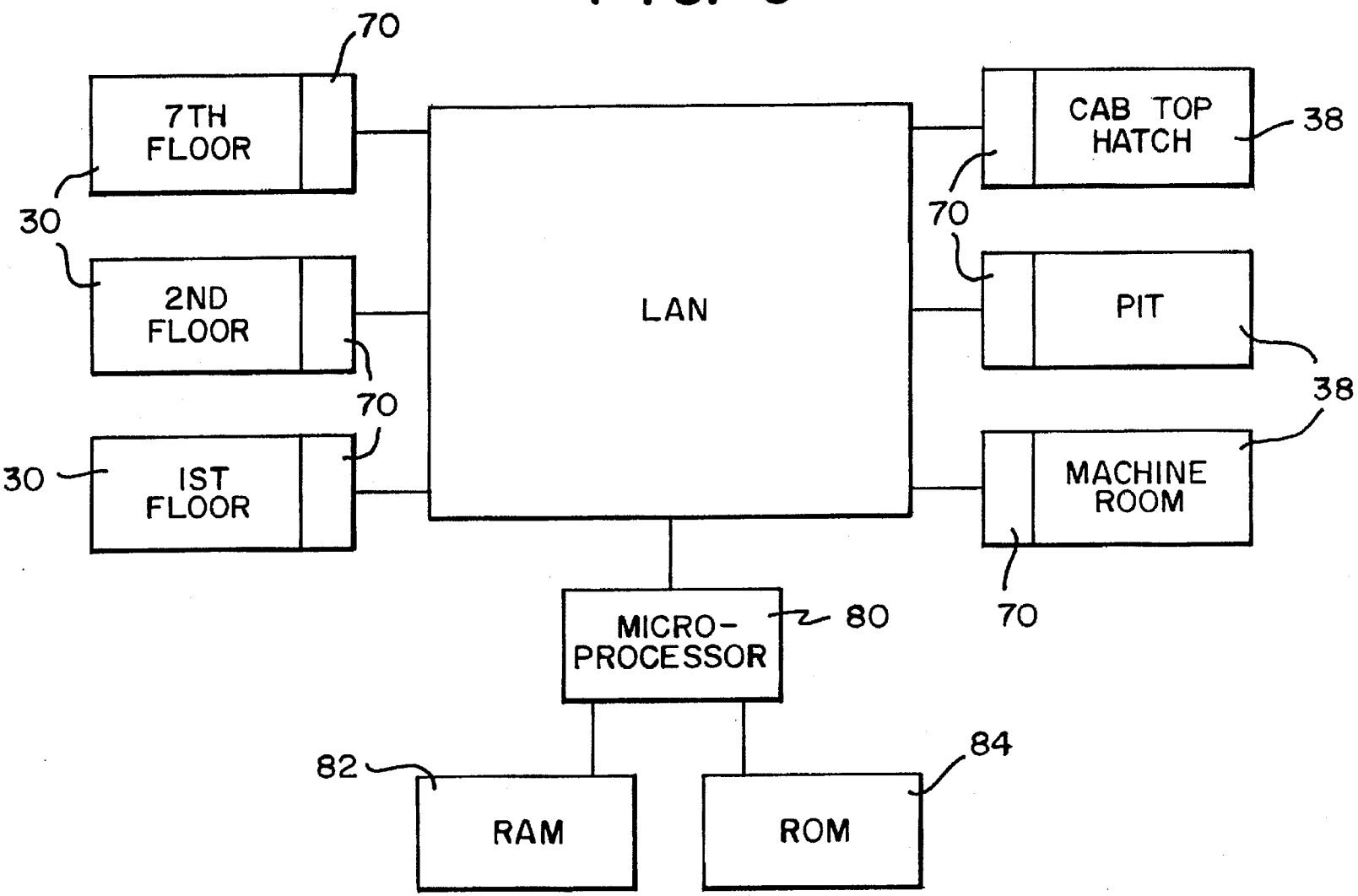
FIG. 6 is a schematic of a control system for the present invention using a microprocessor.

Instead of the relay control circuits shown in FIGS. 4 and 5, a system according to the present invention can be controlled by a preprogrammed microprocessor 80 with random access memory ("RAM") 82 and read only memory ("ROM") 84 as shown in FIG. 6. The program for controlling the microprocessor could be stored in ROM 84. Each of the detectors 30, 38 could be interfaced to a local area network ("LAN") by interface circuits 70. Each interface circuit would periodically note the state of its associated detector and generate a digital code word which indicates the address (e.g. floor or pit) of the detector it is related to and its status. This word would be sent over the LAN to the microprocessor. If detectors were used which could transmit the value for distance from a photoelectric detector to the door and this value were provided to its interface circuit, the microprocessor 80 would have substantial information about the shaft 10. For example, a small distance from the detector at floor 3 would indicated that the elevator was at that floor. Therefore, a large distance from floor 4 would indicate that the hatch at that floor was open and the elevator was not there. Further if someone gained access to the machine room and was sliding down the cable, the detector at the top floor would generate a signal showing the distance changing from standard, i.e. a beam going all the way to the door, to a shorter distance which is not as short as when the cab is present. If arranged as in FIG. 3, the beam would miss the counterweight 15, so the microprocessor would not have to compensate for its travel in the shaft.

Instead of one detector at each floor, additional detectors could be provided, e.g. with one detector generating a beam 35 (FIG. 2) aimed over a cab at that floor to the hatch door, and one detector with a beam 36 (FIG. 2) aimed at the cab. Thus, the microprocessor could determine if the cab were at the floor and stable at the correct level, and whether the hatch door had opened properly.

The information from various detectors can be used by the microprocessor according to its program in any number of ways to monitor the condition of the shaft (i.e. the doors leading thereto) as well as the movement of the cab. A person of ordinary skill in the programming art would be fully capable of designing programs to carry out desired operations. However, by way of example, a flow chart for detecting open hatches is given in FIG. 7.

Figure 7:
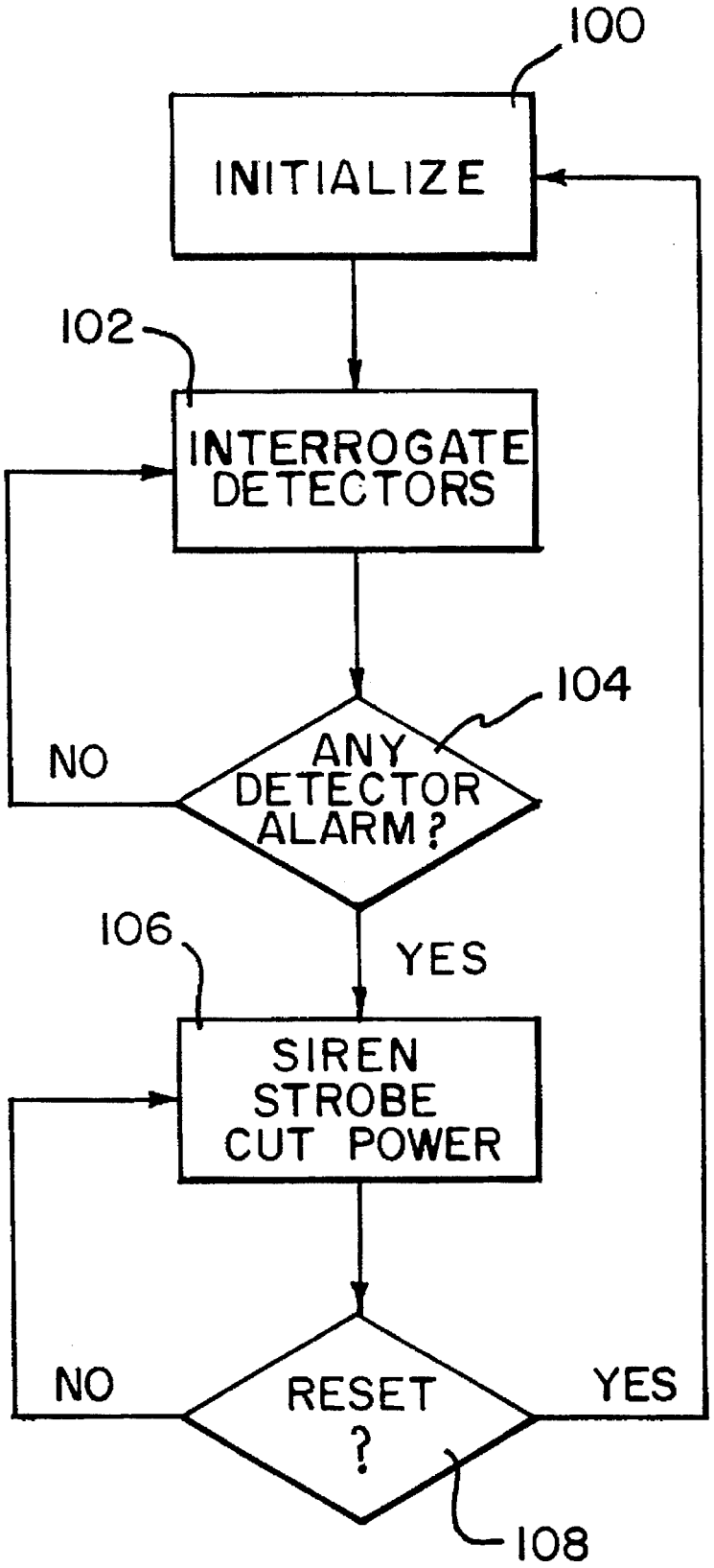
FIG. 7 is a flow chart of a program for the microprocessor of FIG. 6.

According to the flow chart of FIG. 7, the microprocessor 80 is programmed to initialize the circuit and LAN when it is turned on (step 100). It then begins to interrogate the detectors 30, 38, i.e., it requests that the interface circuits 70 report the status of their associated detectors (step 102). This is done sequentially over the LAN and each of the interface circuits reports back in sequence so there is no confusion of signals. The rate at which this interrogation is performed may be important. For example, debris falling in the shaft may give a false reading if the sample is taken too quickly. Also, if the sample is not taken often enough, a person may fall into an open shaft before the alarm is indicated. A report from each detector once a second is likely to be sufficient. In order to avoid false triggering of the system due to transient conditions, it may be advisable to require an alarm condition to exist for several samples before the circuit is activated.

Once the microprocessor has accumulated reports of the status from all of the operating detectors, (some detectors may be deliberately taken out of service, e.g., where a hatch door is broken) it checks to see if any of the detectors has indicated an alarm condition (step 104). If not, the microprocessor continues to monitor the detectors. If an alarm condition is detected, the microprocessor turns on the siren and strobe, and takes the elevator out of service (step 106). The system remains in this state, even if the hatch door is closed or some other cause of the alarm is removed. Instead, the microprocessor monitors the reset switch (step 108). If the reset switch is not operated, the condition of the system does not change. However, when the reset switch is operated, the circuit is initialized (step 100) and the monitoring of the detectors resumes.

Figure 8:
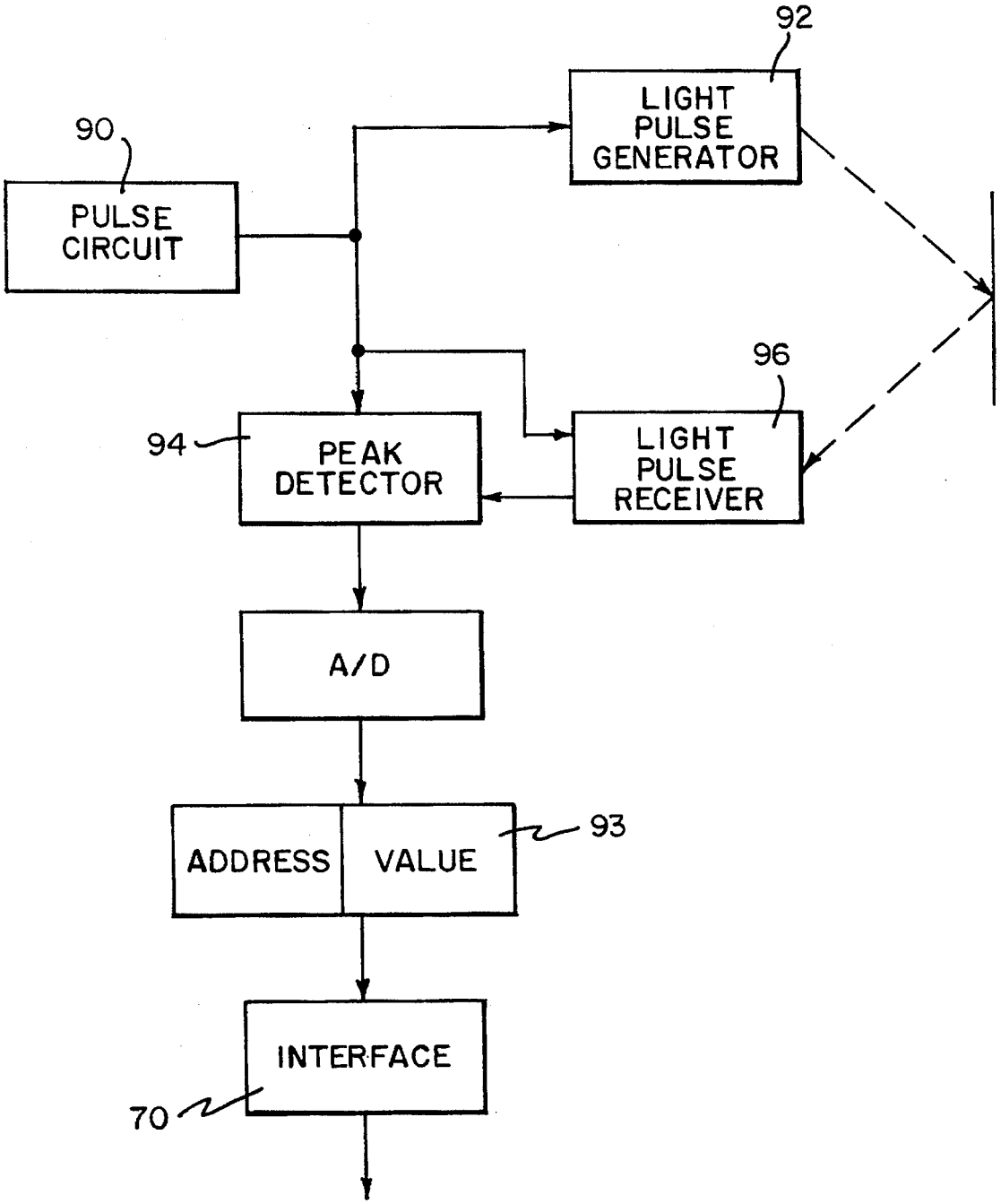
FIG. 8 is a schematic if a detector and interface circuit for the control system of FIG. 6 by which a distance value and address are sent to the microprocessor.

As noted above, if the detector provides an indication of the distance to an object, as opposed to a simple indication of whether the distance is more than some standard, a microprocessor circuit can provide additional features. The circuit of FIG. 8 illustrates a detector and interface circuit that may accomplish this function. In FIG. 8 a pulse circuit 90 sets the rate at which pulses of, e.g., infrared light are sent from a light source or generator 92 to be diffused from an object in its path. At the same time this pulse is sent to light pulse receiver so it looks for a return pulse only during the period immediate after the light pulse is generated in generator 92. When the receiver receives the diffused return beam, its amplitude is peak detected by detector 94. The peak amplitude is an indication of the distance, i.e., the greater the magnitude the shorter the distance. This voltage must be converted to a digital signal for transmission over the LAN. This can be accomplished by an analog-to-digital converter 98.

The digital value that is related to the distance measured by the detector is saved in a latch circuit 93, which also contains a digital code for the address of the detector. This latch is made available to interface circuit 70 which is connected to the LAN. Whenever an interrogation signal is received from the microprocessor addressed to this interface, it reads the distance value and address code from latch 93 and transmits them as a digital code word over the LAN to the microprocessor. Since the microprocessor now has information not only on whether the pulse is returned within a standard time, but also on what the distance is, it can perform other functions as exemplified by the flow chart of FIG. 9.

Figure 9:
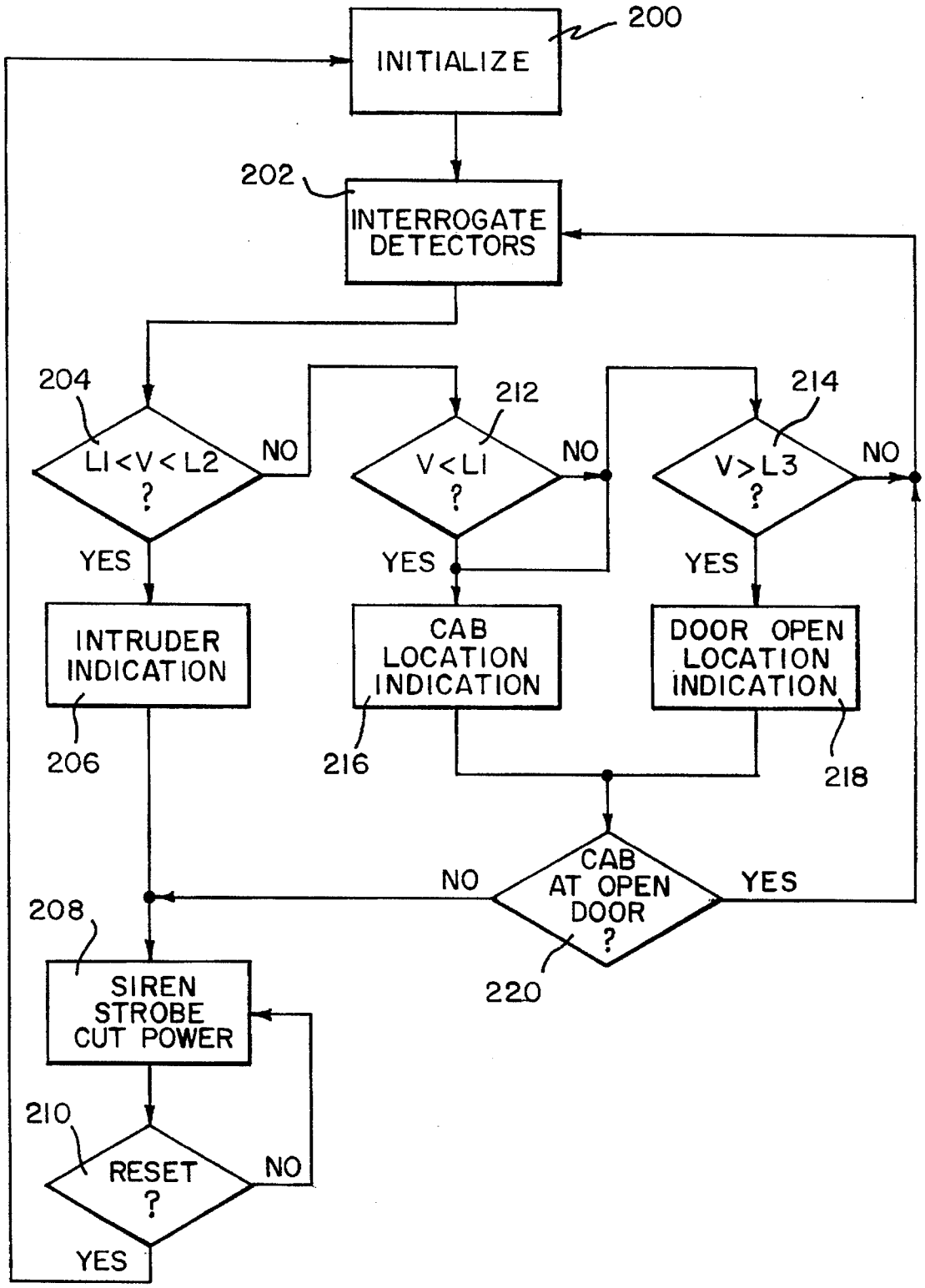
FIG. 9 is a flow chart of a program for the microprocessor of FIG. 6 using the detector and interface of FIG. 8.

As in the program illustrated by FIG. 7, the program illustrated by FIG. 9 begins with initialization and interrogation steps 200, 202. When the distance values from the detectors are received, they are first checked in step 204 to see if any of these are between a low value (level 1 or L1) and a mid value (level 2 or L2). The L1 value is set to be just beyond the nominal distance to the elevator cab and the value L2 is a distance about three quarters of the way across the shaft. Thus values in the range between L1 and L2 are likely to be produced by an intruder that has somehow gained access to the shaft, perhaps through a broken hatch door on a floor where the detector has been taken out of service. This would include an intruder sliding down the cables or riding on top of the car. In any event, if such a signal is present, the microprocessor sets an indicator (step 206) that there is an intruder present and his location, based on the address of the detector that produced the signal. Then the siren and strobe are turned on and power to the elevator is cut (step 208). As in the program of FIG. 7, the system remains in this state until it is reset in step 210.

The detectors can include two units at each floor, i.e. one looking for a cab and the other set above the cab to reach the hatch door. These detectors can be arranged so they do not detect any normal equipment moving in the shaft, e.g., cables or counterweights.

If there is no signal between L1 and L2, the program than checks to see if there are any signals with distances less than L1 (step 212). Subsequently it checks to see if there are any signals with distances greater than L3 (step 214), where L3 is the distance to the door being monitored. If the signal is less than L1 it is assumed to have been caused by the cab and an indicator is set (step 216) showing that the cab is at the address of the detector that produced that signal. Whether there is or is not a signal less than L1, the program checks for signals greater than L3. If a signal is greater than L3 is found an indicator is set at step 218, which shows that the hatch or other door at the location of the related address is open. If there is no signal greater than L3, the system continues to monitor the detectors starting at step 202.

At step 220 the system checks the cab location and the open door location. If the hatch door is open at a floor where the cab is located, the system continues to monitor the detectors. If the hatch door is open on a floor and the cab is not there, the alarm sequence in steps 208 and 210 is initiated.

Thus it can be seen that the system with a microprocessor can achieve sophisticated control and protection of an elevator shaft.

While the invention has been particularly shown and described with reference to preferred embodiments thereof, it will be understood by those skilled in the art that various changes in form and details may be made therein without departing from the spirit and scope of the invention.

We claim:

1. An elevator shaft door monitoring system which determines if any door to an elevator shaft at any floor along the elevator shaft is opened while an elevator cab is away from the door, comprising:

a plurality of non-contact door monitors, each monitor being mounted in the shaft toward a rear wall of the shaft at a respective location generally opposite each door being monitored along the shaft, each such monitor being directed at the respective door and detecting the opening of the respective door without direct contact therewith, and producing an alarm signal whenever the respective door is being opened and the elevator cab is not at the floor where the door is being opened; and control circuit for receiving the alarm signals from the monitors and indicating an alarm condition whenever an alarm signal is received.

2. An elevator shaft door monitoring system as claimed in claim 1 wherein said non-contact door monitors are diffused photoelectric detectors and at least one of the doors being monitored is a hatch door.

3. An elevator shaft door monitoring system as claimed in claim 2 wherein said diffuse photoelectric detectors comprise:

a radiation source that periodically generates a pulse of radiation at a particular frequency, a receiver that receives the pulse of radiation after it is diffused from the door, an amplitude detector which measures the amplitude of the pulse received by the receiver, and a comparator for comparing the measured amplitude to a predetermined value and creating an alarm signal wherever the measured amplitude is less than the predetermined value.

4. An elevator shaft door monitoring system as claimed in claim 3 wherein said source is a source of electromagnetic radiation.

5. An elevator shaft door monitoring system as claimed in claim 4 wherein said source is a source of infrared light radiation.

6. An elevator shaft door monitoring system as claimed in claim 1 wherein said non-contact door monitors are diffused microwave detectors and at least one of the doors being monitored is a hatch door and wherein said microwave detectors comprise:

a microwave radiation source that periodically generates a pulse of radiation at a particular frequency, a receiver that receives the microwave radiation after it is diffused from the door, an amplitude detector which measures the amplitude of the pulse received by the receiver, and a comparator for comparing the measured amplitude to a predetermined value and creating an alarm signal whenever the measured amplitude is less than the predetermined value.

7. An elevator shaft door monitoring system as claimed in claim 1 wherein said non-contact door monitors are diffused sonic radiation detectors and at least one of the doors being monitored is a hatch door, and wherein said sonic radiation detectors comprise:

a sonic radiation source that periodically generates a pulse of sonic radiation at a particular frequency, a receiver that receives the sonic radiation after it is diffused from the door, an amplitude detector which measures the amplitude of the pulse received by the receiver, and a comparator for comparing the measured amplitude to a predetermined value and creating an alarm signal whenever the measured amplitude is less than the predetermined value.

8. An elevator shaft door monitoring system as claimed in claim 3 wherein said source is positioned to direct the radiation to a portion of the elevator shaft door which is first opened.

9. An elevator shaft door monitoring system as claimed in claim 1 wherein said source is positioned to directed the radiation such that it is intercepted and diffused by the elevator cab when the cab is adjacent the door, whereby the amplitude of the diffused radiation is less than when the cab is away from the door and the door is closed.

10. An elevator shaft door monitoring system as claimed in claim 3 wherein said radiation source is positioned to direct the radiation to a portion of the hatch door of an elevator cab which is first opened.

11. An elevator shaft door monitoring system as claimed in claim 1 wherein said control circuit is a relay control circuit in which control relays are operated by said monitors and act to supply power to an alarm.

12. An elevator shaft door monitoring system as claimed in claim 11 in which the control relays cause an indicator to illuminate showing what monitor caused the alarm.

13. An elevator shaft door monitoring system as claimed in claim 11 in which the alarm is at least one of a siren and a strobe.

14. An elevator shaft door monitoring system as claimed in claim 1 wherein said control circuit is a preprogrammed microprocessor.

15. An elevator shaft door monitoring system as claimed in claim 14, wherein there are at least two monitors at each floor, one monitors a hatch door at the floor and the other monitors the presence of the elevator cab.

16. An elevator shaft door monitoring system as claimed in claim 14 wherein the monitors are connected to the microprocessor by a local area network and each monitor has an interface circuit connected between it and the network.

17. An elevator shaft door monitoring system as claimed in claim 16 wherein the monitor produces a signal indicating the distance from the monitor to an object.

18. An elevator shaft door monitoring system as claimed in claim 17 wherein the monitors are proximity detectors comprising a radiation source that periodically generates a pulse of radiation, a receiver that receives the pulse of radiation after it is diffused from the hatch door, an amplitude detector which measures the amplitude of the pulse received by the receiver, and means for converting the amplitude into a digital distance signal for transmission to the microprocessor over the local area network.

19. An elevator shaft door monitoring system as claimed in claim 18 wherein the interface circuit combines the digital distance signal with a digital address signal for the detector and combines them into a digital word for transmission to the microprocessor over the local area network.

20. An elevator shaft door monitoring system as claimed in claim 1 wherein the alarm signal actuates at least one of a siren and a strobe.

21. An elevator shaft door monitoring system as claimed in claim 20 wherein a siren and strobe are located at each floor.

22. An elevator shaft door monitoring system as claimed in claim 2 wherein at least one of the doors being monitored is one of a pit door, a machine room door and an elevator cab escape hatch.

23. An elevator shaft door monitoring system as claimed in claim 18 wherein the microprocessor, on the basis of the distance signals, determines at least one of whether the elevator cab is at the monitor, a hatch door to the elevator shaft is open and an intruder is in the shaft.

24. An elevator shaft door monitoring system as claimed in claim 1 further including an elevator shut down circuit wherein the alarm signal acts to operate the elevator shut down circuit and take the elevator out of service.

25. An elevator shaft door monitoring system as claimed in claim 24 further including at least one of a smoke detector and fire detector, operation of at least one of said smoke and fire detectors acting to inhibit operation of the elevator shut down circuit.

26. An elevator shaft door monitoring system which determines if any door to an elevator shaft at any floor along the elevator shaft is opened while an elevator cab is away from the door, comprising:

at least two non-contact door monitors being provided at a floor, each door monitor being mounted in the shaft at a respective location generally opposite each door being monitored along the shaft, each such door monitor being directed at the respective door and detecting the opening of the respective door without direct contact therewith, whereby one door monitor monitors a hatch door at the floor and the other door monitor monitors the presence of the elevator cab, each door monitor produces an alarm signal whenever a respective door is being opened and the elevator cab is not at the floor where the door is being opened on the basis of a distance signal produced by each door monitor whereby the distance is determined from the respective door monitor to an object;

a preprogrammed microprocessor for receiving the alarm signals and distance signals from each door monitor and indicating an alarm condition whenever an alarm signal is received; and a local area network connecting each monitor to the microprocessor whereby each door monitor has an interface circuit connected between it and the network.

27. An elevator shaft door monitoring system which determines if any door to an elevator shaft at any floor along the elevator shaft is opened while an elevator cab is away from the door, comprising:

a plurality of non-contact door monitors, each door monitor being mounted in the shaft at a respective location generally opposite each door being monitored along the shaft, each such door monitor being directed at the respective door and detecting the opening of the respective door without direct contact therewith, and producing an alarm signal whenever the respective door is being opened and the elevator cab is not at the floor where the door is being opened;

a control circuit for receiving the alarm signals from the door monitors and indicating an alarm condition whenever an alarm signal is received;

an elevator shut down circuit wherein the alarm signal acts to operate the elevator shut down circuit and take the elevator out of service; and at least one of a smoke detector and fire detector, operation of at least one of said smoke and fire detectors acting to inhibit operation of the elevator shut down circuit.

* * * * *